US009555939B2

(12) United States Patent
Chehadeh

(10) Patent No.: US 9,555,939 B2
(45) Date of Patent: Jan. 31, 2017

(54) BOTTLE FOR UPRIGHT AND INVERTED USE

(71) Applicant: Marwan Chehadeh, San Diego, CA (US)

(72) Inventor: Marwan Chehadeh, San Diego, CA (US)

( * ) Notice: Subject to any disclaimer, the term of this patent is extended or adjusted under 35 U.S.C. 154(b) by 25 days.

(21) Appl. No.: 14/638,505

(22) Filed: Mar. 4, 2015

(65) Prior Publication Data

US 2016/0257461 A1 Sep. 8, 2016

(51) Int. Cl.

| | |
|---|---|
| ***B67D 3/00*** | (2006.01) |
| ***B65D 47/26*** | (2006.01) |
| ***B65D 83/00*** | (2006.01) |

(52) U.S. Cl.

CPC ..... *B65D 47/266* (2013.01); *B65D 83/0055* (2013.01)

(58) Field of Classification Search

CPC .... B65D 47/266; B65D 47/268; B65D 47/205
USPC ..... 222/533–537, 556, 563, 526, 153.13,222/153.14; 215/206, 221, 225, 235

See application file for complete search history.

(56) References Cited

U.S. PATENT DOCUMENTS

| | | | | |
|---|---|---|---|---|
| 5,314,093 | A * | 5/1994 | Gross | B65D 50/067 215/235 |
| 6,382,469 | B1 * | 5/2002 | Carter | B65D 83/205 222/153.06 |
| 6,971,547 | B2 * | 12/2005 | Englert | B65D 50/06 222/1 |
| 7,530,476 | B2 * | 5/2009 | Downey | B65D 83/205 222/153.04 |
| 8,418,892 | B2 * | 4/2013 | Geier | B65D 83/205 222/402.11 |
| 9,260,237 | B2 * | 2/2016 | Brace | B65D 83/226 |
| 2002/0113097 | A1 * | 8/2002 | Harriman | B65D 35/44 222/534 |
| 2005/0184093 | A1 * | 8/2005 | Brunerie | B65D 83/22 222/153.11 |

* cited by examiner

*Primary Examiner* — Lien Ngo
(74) *Attorney, Agent, or Firm* — Donn K. Harms

(57) ABSTRACT

A liquid dispensing container is provided having a cap assembly preventing dispensing of fluid therefrom prior to both an alignment of markers and a pivoting of a nozzle which helps prevent use by children lacking dexterity and knowledge for achieving concurrent positioning of the nozzle and markers. A tamper alarm prior to purchase is provided by a pillar and tab preventing dispensing until removed, which if removed, provide a visually discernable alarm to tampering with the container. The container is capable of inverted dispensing with upward projection of fluid by the pivoting nozzle engaged with a cap assembly.

9 Claims, 6 Drawing Sheets

BOTTLE FOR UPRIGHT AND INVERTED USE

FIELD OF THE INVENTION

The disclosed device relates generally to a squeeze bottle for dispensing of a liquid. More particularly it relates to a flexible squeeze bottle configured for both upright and inverted use, which includes a rotatable dispensing turret, and may also include a safety positioning requirement to prevent use by children, and a tamper seal providing a visually discernable signal if the bottle has been tampered with prior to purchase.

BACKGROUND

Plastic squeeze bottles for dispensing cleaners, soaps, and other liquids have been manufactured for many years and are well known. Such bottles are employed for soaps, shampoos, cleaning solutions and hundreds of other uses. Most such flexible bottles where the dispensing component is conventionally engaged to a centered opening in the bottle, are configured primarily for upright use, or use in a vertical disposition. They are unable due to the dispensing component engaged to the bottle, to disperse liquid from the bottle in and direction but substantially along the axis of the bottle to which the dispensing component is engaged.

There other flexible bottles configured to be employed in an inverted positioning, and dispense the liquid in the bottle at a direction traverse to the axis of the inverted bottle or even at an upward angle from the inverted dispensing component and bottle. Such bottles are employed for instance when communicating cleaning solution on the bottle to the underside of a rim surrounding a toilet bowl. Bottles employed for this inverted positioning are employed widely and in order to provide this inverted dispensing of fluid, have a gooseneck appearance where the opening to the bottle and the dispensing end are positioned at the distal end of a curved neck portion of the bottle.

However, bottles with curved ends leading to the opening have a number of problems. First, they are not well adapted to simply be used in an inverted positioning to for instance, disperse shampoo into one hand of a user while being held by the other hand. Due to the curved neck, they inherently dispense the fluid at and angle whereby the user must hold one hand spaced from the other horizontally, rather than in the normal fashion where the hand receiving the fluid is located inline with the longitudinal axis of the dispensing bottle.

Another more vexing problem for manufacturers of fluid products contained in such gooseneck style bottles, is that the filling neck of a bottle with a curved portion leading to the bottle opening, is disposed at an angle to the longitudinal axis of the bottle when standing upright on the bottle base. Machinery employed to fill bottles with fluid in factories work well and fast where the bottle opening is in line with the bottle axis. However, when the bottle opening is at an angle traverse to the bottle axis, and spaced therefrom by the distance of the curved portion of the bottle, special machinery is required to fill the curved neck bottles causing increased cost and a limiting of choice of bottlers to provide service since most do not have the assembly-line capacity to fill curved neck bottles.

Consequently, providers of liquids which are sold for dispensing at an angle traverse to the axis of the bottle, are left with few options as to the bottlers they use. Further, the cleaners used and dispensed from many such curved neck bottles, are the same liquid used for other cleaning tasks in the home. However users must purchase two different bottles for the same cleaner if they wish to have one for dispensing inline with the axis of the inverted bottle in a normal fashion, and one bottle to dispense liquid at an angle away from the axis of the inverted bottle. Also, manufacturers must purchase, fill, ship, and sell two types of bottles for similar or the same cleaning solution.

Still further, cleaning solutions, soap, shampoo, and other liquid product dispersed from such containers, can be hazardous to children should they come in contact with them or ingest them. Conventional containers whether for inline dispensing from an axially located dispensing component, or from a dispensing component which is engaged to a curved neck, ideally should provide a safety cap configuration to prevent children from coming into contact with the contents.

As such, there is an unmet need for a fluid container which is configured with an opening for filling and engagement of a dispensing component, which is located along the longitudinal axis of the container. Such a container should be employable for the dispensing of cleansers as well as shampoos and cosmetic products and the like to eliminate the need for manufacturers to use multiple container styles. Such a fluid container should have a dispensing component which is employable to dispense fluid to the hand or person of the user, or, in a stream at an upward angle from the inverted container. Such a fluid container should be configured with components rendering it child-resistant, to help prevent children from coming into contact with the contents or ingesting such. Still further, such a container should include a tamper-resisting component which will alert a buyer that the container has been tampered with prior to purchase.

With respect to the above, before explaining at least one preferred embodiment of the squeezable fluid container herein in detail or in general, it is to be understood that the invention is not limited in its application to the details of employment and to the arrangement of the components or the steps set forth in the following description or illustrated in the drawings. The various apparatus and methods of the herein disclosed container invention are capable of other embodiments, and of being practiced and carried out in various ways, all of which will be obvious to those skilled in the art once the information herein disclosed is reviewed thereby.

Also, it is to be understood that the phraseology and terminology employed herein are for the purpose of description and should not be regarded as limiting. Consequently, those skilled in the art will appreciate that the conception upon which this disclosure of an improved fluid container is based, may readily be utilized as a basis for other fluid containers. It is important, therefore, that the embodiments, objects and claims herein, be regarded as including such equivalent construction and methodology insofar as they do not depart from the spirit and scope of the present invention.

SUMMARY OF THE INVENTION

The disclosed squeeze bottle device overcomes the noted shortcomings of the prior art, through the provision of a bottle which is fillable through a filling neck located along the longitudinal axis of the bottle in an upright position, and is employable in an inverted position to dispense fluid either at an upward angle to place it onto an underside target, or to simply dispense fluid into the hand of a user. The device thus will thus serve the purpose of dispensing fluid such as shampoos, soaps, detergents and the like from the outlet and onto the hand or a target immediately adjacent the outlet, and, allow for the projection of contained fluid to a remote target which is above and adjacent the outlet of the dispenser when the bottle is inverted.

Thus the bottle can serve the purpose of the conventional curved or gooseneck bottle, as well as a conventional soap or detergent bottle in one container. Further, in eliminating the need for the curved neck, the disclosed bottle herein can be filled in factories with conventional bottle filling equipment for fill necks located along the longitudinal axis of the squeeze bottle. This eliminates the need for manufacturers to have two bottles for the same or similar products, and, allows for the filling of a bottle which will project fluid at an upward angle from the inverted dispenser, on a conventional bottle filling line for axially located fill necks.

In addition to providing a dual use fluid bottle, the disclosed device may also have a child-resistant component which will help prevent a child from contacting or ingesting the contents of the bottle. Currently such is provided by requiring a collar component of the cap engaging the neck of the bottle, to be rotated. In such rotation, a first marker or indicia such as an arrow on the collar, must be aligned with a second marker or indicia on the bottle, otherwise a dispensing component which is rotationally engaged with the cap collar, will not rotate to a dispensing position and as such, will prevent fluid from being dispensed therefrom.

Additionally employable with the disclosed bottle herein, is the provision of a component to alert a buyer in case tampering has occurred with the bottle prior to purchase or use by the user. Currently such a tamper alerting component is a detachable member engaged to the collar of the cap. The detachable member covers a portion of the marker used to align the collar with the marker on the bottle. Further, the detachable member is spaced from the exterior surface of the circumference of the cap collar such that it will not allow rotation of the collar to reach an alignment of the marker on the collar and the mating marker on the bottle.

It is an object of this invention, to provide a squeeze bottle which is capable of dispensing fluid contents when inverted, at an upward angle which is traverse to the axis of the inverted bottle.

It is a further object of this invention to provide such a bottle which will angularly dispense when inverted, but which has an axially located filler neck allowing for filling therethrough.

It is yet another object of this invention to provide the aforementioned improved bottle which is also adapted to be child-resistant to prevent contact or ingestion of the bottle contents with a child.

It is a still further object of this invention to provide the noted bottle herein, with a visual alert to tampering with the bottle for buyers and users thereof.

The foregoing has outlined some of the more pertinent objects of the improved container or squeeze bottle device herein provided by the disclosed apparatus and system herein. These objects should be construed to be merely illustrative of some of the more prominent features and applications of the intended invention. Many other beneficial results can be attained by applying the disclosed system and apparatus in a different manner or by modifying the invention within the scope of the disclosure.

Accordingly, other objects and a fuller understanding of the invention may be had by referring to the summary of the invention and the detailed description of the preferred embodiment in addition to the scope of the invention defined by the claims taken in conjunction with the accompanying drawings.

DETAILED DESCRIPTION OF THE INVENTION

Referring now to FIGS. 1-14 herein, wherein similar components of the device 10 are identified by the same numerals.

Figure 1:
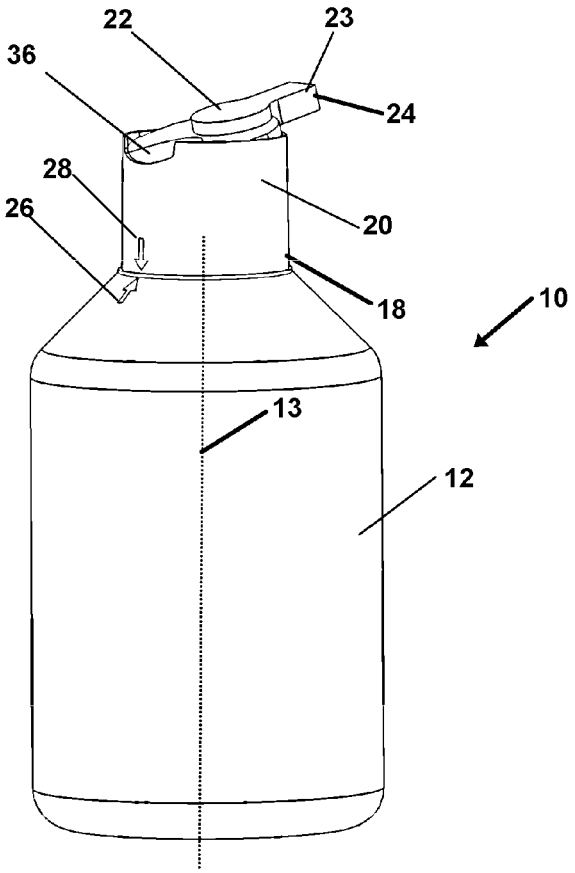
FIG. 1 is a depiction of the container herein described for convenience as the bottle, in an upright positioning supported on a lower endwall.

As can be seen in FIG. 1, the disclosed device 10 includes a container herein for convenience described as a bottle 12 formed by a sidewall 14 and endwall 16 and has a cap assembly 18 including a rotating collar 20 having an engaged dispensing nozzle 22 with a dispensing aperture 24 at the distal end of a projecting portion of the nozzle 22.

Also shown is a first marker 26 positioned on the bottle 12 which must be aligned with a second marker 28 positioned on the collar 20 of the cap assembly, in order for the contents of the bottle 12 to be communicated to and dispensed from the dispensing aperture 24. The requirement of rotation of the collar 28 to align the second marker 28 with the first marker 26, which allows for a rotation of the nozzle 22 in its engagement with the collar 20, wherein fluid within the bottle 12 is dispensable from the nozzle 22 provides a child-resistant mode to the device 10 to prevent dispensing of the liquid within the interior cavity (not shown) of the bottle 12 unless or until the two markers are aligned, and, the nozzle 22 is rotated to a dispensing position, in its engagement with the collar 28.

Figure 2:
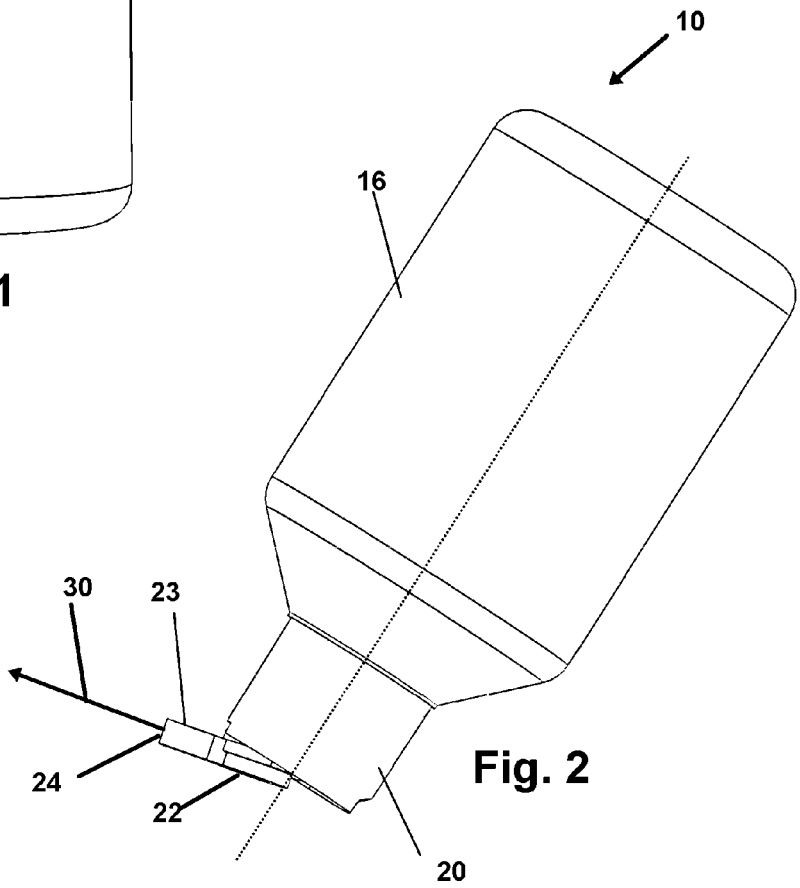
FIG. 2 is a side view of the bottle herein in an first inverted positioning wherein fluid held within the bottle is dispensable in a stream directable to an elevation higher than the elevational location of a dispensing aperture in fluid communication with the bottle interior.
Figure 2A:
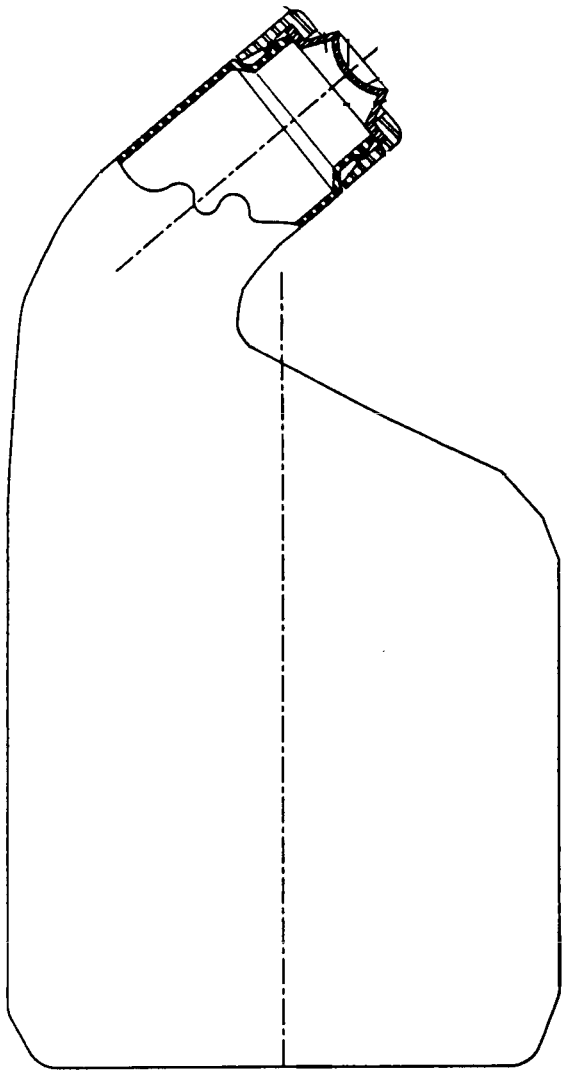
Fig. 2a (Prior Art)
FIG. 2*a* shows a conventional prior art bottle having a curved portion leading to a fill opening covered by the dispensing cap.

A particularly preferred ability of the device 10 herein, is shown in FIG. 2, which depicts a side view of the bottle 12 with the nozzle 22 rotated and depressed to a dispensing position, in an inverted positioning. As can be seen, in this inverted positioning, the projecting portion 23 of the nozzle 22, allows for a dispensing of a fluid stream 30 in a trajectory which will project the fluid stream 30 to a target at an elevation above the dispensing aperture 24. This ability provided by the components of the device 10 herein, allows for the bottle 12 to be employed for situations similar to that of the conventional curve-necked bottle of FIG. 2*a*. However, unlike the prior art bottle of FIG. 2*a,* which requires a specialized and expensive modification to conventional bottle-filing equipment at bottle filling plants, the device 10 herein, can be filled in the conventional fashion, using conventional bottle filling equipment adapted to fill the bottle 12 when upright, through an axially-located opening 32 (FIG. 4).

Consequently, the device 10 herein provides exceptional utility in that the bottle 12 is can be filled with fluid with conventional bottle filling equipment reducing costs and expanding distribution potential for the child-resistant device 10. However, in an inverted dispensing positioning such as in FIG. 2, the device 10 will provide the utility of prior art bottles such as in FIG. 2*a,* and will project a fluid stream 30 to contact with a target such as a toilet bowl rim, which is at an elevation higher that the dispensing aperture 24 of the bottle 12.

Figure 3:
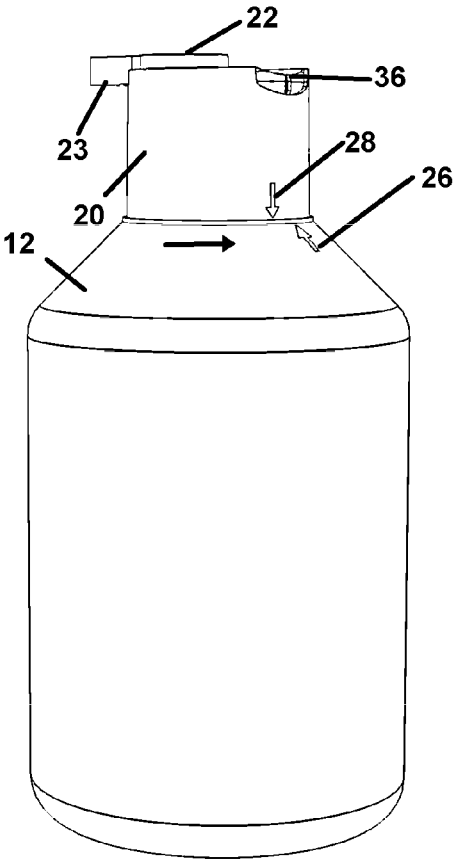
FIG. 3 shows the child-resistant engagement of the cap to the bottle wherein markers on each must be aligned or fluid communication from the bottle through the dispensing aperture is prevented.

In FIG. 3 is shown an example of the child-resistant positioning of the cap assembly 18. As can be seen in FIG. 3, in order for fluid within the bottle 12 interior cavity, to be communicated through a fluid pathway to the dispensing aperture 24 in the nozzle 22, a rotation of the turret-engaged collar 20 is required, and a depression 36. The collar 20 of the cap assembly 18 must be rotated in its sealed rotational engagement with a projecting annular projection 34 surrounding the opening 32 communicating with an interior cavity of the bottle 12 wherein a fluid supply is maintained. Until the collar 20 is rotated to position the second marker 28 in an alignment with the first marker 26, fluid communication through a fluid pathway from the opening to the dispensing aperture 24 is blocked and prevented. This requirement of aligned positioning of the markers 26 and 28, through rotation of the collar 20 of the cap assembly 18, has been found to be outside the understanding and/or dexterity of most small children.

Figure 4:
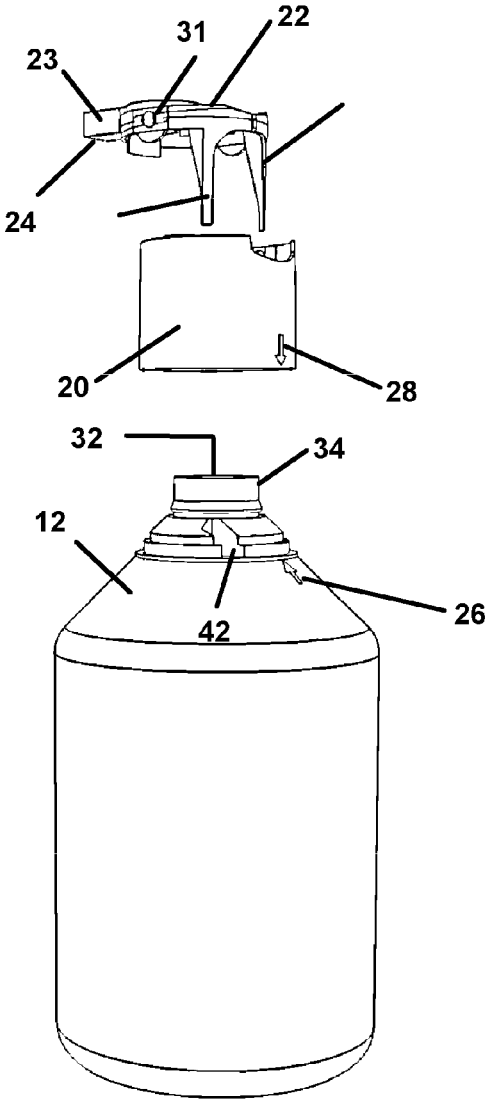
FIG. 4 shows an exploded view of FIG. 3.

In FIG. 4 can be seen an exploded view of the device 10 shown in FIG. 3, however with the collar 20 and cap assembly 18 rotated to align the first marker 26 with the second marker 28 to therefrom allow the nozzle 22 to be rotated on an axle 31 engaging the collar 22. Pivoting of the nozzle 22 is accomplished by depressing a first end 36 thereof, which causes a rotation on the axle 31 engaged with the collar 20 (FIG. 7) and only then, opens the fluid pathway for fluid communication from the interior cavity of the bottle 12 to the dispensing aperture 24 such that squeezing the compressible bottle 12 will cause ejection of fluid under pressure from the dispensing aperture 24. Thus, not only does the user need to align markers 26 and 28, the user must then pivot the positioning of the nozzle 22 both of which are not easily accomplished by a child.

However, this depression of the first end 36 of the nozzle 22 and resulting rotation or pivoting of the nozzle 22 on the axle 31 engaged with a race in the collar 20, to position the nozzle to a dispensing position, is prevented, until the first marker 26 is aligned with the second marker 28, thereby preventing fluid dispensing until the markers 26 and 28 are aligned and the nozzle pivoted.

The alignment of the two markers 26 and 28 by rotation of the collar 20, concurrently aligns at least one projecting member 40 with a recess 42, formed into the body of the bottle 12. As depicted, (FIGS. 4 and 7) alignment of the two markers 26 and 28 concurrently alines two projecting members 40 extending in directions traverse to that of the projecting portion 23, with each of two recesses 42 formed into the bottle 12 adjacent the annular projection 34 to allow rotation of the nozzle 22 in its engagement with the collar 20 which is prevented by contact of the projecting members 40 with the exterior surface of the bottle 12 adjacent to the recesses 42. Of note the device 10 would provide this preventive function with a single projecting member 40 and one recess 42 however a favored mode includes two of each for enhanced safety.

As such, it is the alignment of the two markers 26 and 28 which aligns the projecting members 40 with the recesses 42 which allow the user to depress the first end 36 of the nozzle 22 to rotate it in engagement with the collar 20 to a depressed or dispensing position. Consequently, fluid communication through an internal fluid pathway communicating between the interior of the bottle 12 and dispensing aperture 24 is blocked when the nozzle is in the first position of FIG. 3, and opened when the nozzle 20 is rotated to align markers and subsequently placed in the depressed position of FIGS. 2, 5, and 6. This adds a double layer of safety to prevent dispensing of fluid.

In the depressed position of the nozzle 20, fluid from the interior of the bottle 12 when inverted and squeezed, will communicate from the interior cavity of the bottle 12, through the formed fluid pathway in the nozzle assembly 18, to exit in a fluid stream 30 from the device 10.

Figure 5:
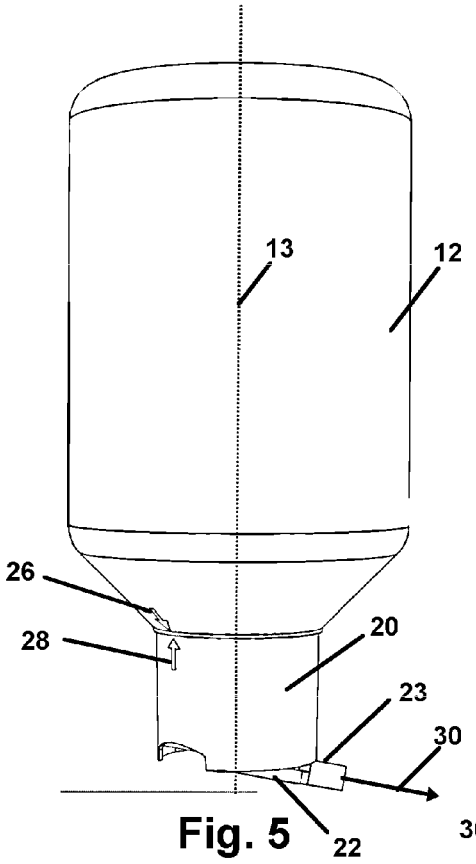
FIG. 5 depicts another inverted dispensing positioning of the bottle herein wherein the axis is substantially plum and the fluid projected from the dispensing aperture by squeezing the bottle exits in a stream downward or a negative angle from an imaginary line normal to the axis.

One mode of fluid dispensing is shown in FIG. 5, wherein the nozzle 22 is in the rotated or depressed position in the rotational engagement with the collar 20, and the fluid stream 30 will eject under pressure when the bottle 12 is squeezed in a directional line extending below the elevation of the dispensing aperture 24. However as noted earlier, the axis 13 of the bottle 12 can be tilted at an angle to allow for the fluid stream 30 to be projected and hit a target at an elevation above that of the dispensing aperture 24 also, and to positions therebetween.

Figure 6:
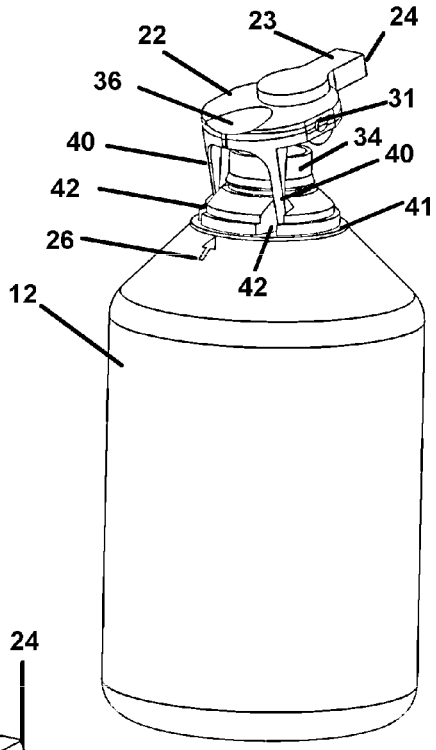
FIG. 6 is a perspective view of the device herein wherein the child-resistant markers are aligned to allow fluid dispensing wherein a collar portion of the cap is removed for disclosure of dispensing component rotationally engaged therewith.
Figure 7:
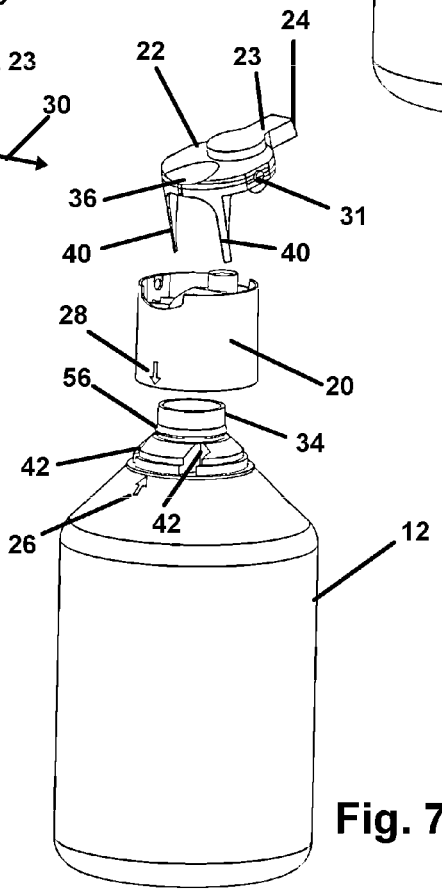
FIG. 7 depicts the device of FIG. 6 in exploded view with the cap collar present.

As shown in FIGS. 6 and 7, a depressed positioning of the nozzle 22 with the collar 20 removed for clarity is shown in FIG. 6, and in exploded view in FIG. 7. As can be seen, with the first marker 26 aligned with the second marker 28 as in FIG. 7, the projecting members 40 of the nozzle 22 are aligned and translated into the recesses 42 formed into the sidewall of the bottle 16 allowing this rotation of the nozzle 22. Without the projecting members 40 in this alignment with the recesses 42, rotation of the nozzle 22 to the depressed position of FIGS. 2, 5, 6 and 7, is prevented as the distal ends of the projecting members 40 will contact an annular race 41 encircling the bottle 16 around the annular projection 34 at the dispensing end thereof.

Figure 8:
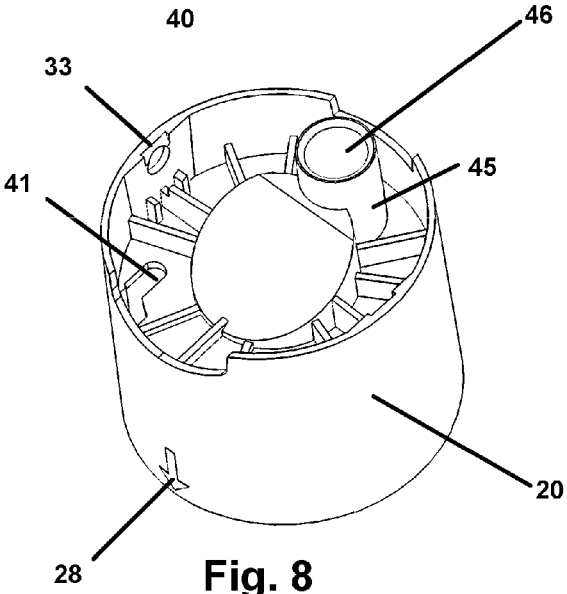
FIG. 8 shows a perspective overhead view of the collar component of the cap and depicting the collar marker and a conduit rising vertically to communicate fluid from the bottle interior to the dispensing component.

The components of the nozzle assembly 18 are shown in various positions to better depict operation thereof. In FIG. 8, a perspective overhead view of the rotationally engaged collar 20 is shown with the second marker 28. Also shown is a conduit 46 which communicates through a passage 48 (FIG. 9) with a central conduit 50 formed in a first side of the collar 20. The central conduit 50 has a cicumfrential surface configured to rotationally engage upon the projecting annular projection 34 in a sealed rotational engagement of the nozzle much like a turret. There are numerous ways to accomplish this sealed rotational engagement between the flexible collar 20 and annular projection 34 and currently an annular recess 54 (FIG. 9) will slide over and engage with a projection ring 56 (FIG. 7).

Figure 10:
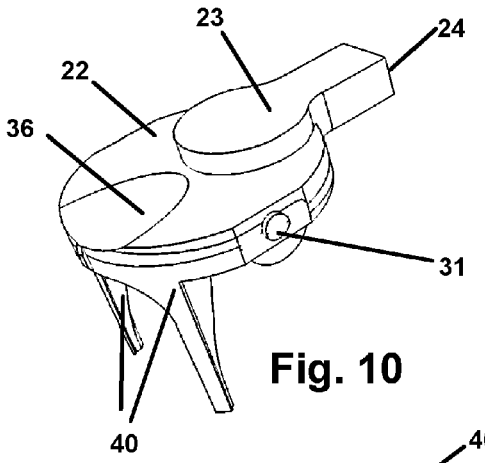
FIG. 10 depicts the dispensing component having opposing projecting members for a pivoting engagement with the a complimentary receiving component in the collar.

In FIG. 10 is depicted the nozzle 22 component having opposing projecting axles 32 for a pivoting engagement with complimentary receiving components 33 formed in the collar 20. The projecting members 40 are positioned to communicate through member apertures 41 formed in the collar 20, to allow the distal ends of the projecting members 40 to contact the exterior of the bottle 16 such as along the race 41 encircling the dispensing end of the bottle 16 rendering the nozzle 22 to a non-dispensing position. When the markers 26 and 28 align, the members 40 may translate into the recesses 42 depending into the surface of the bottle 16 adjacent the race 41 allowing the nozzle 22 to pivot to the dispensing position wherein fluid is dispensable through the nozzle 22 from the interior of the container herein shown as the bottle 12. As noted, absent an alignment of the recesses 42 with the members 40, the members 40 will ride on the race 41 and prevent the nozzle 22 from pivoting in its engagement with the collar 20 to the dispensing position such as in FIG. 1.

Figure 11:
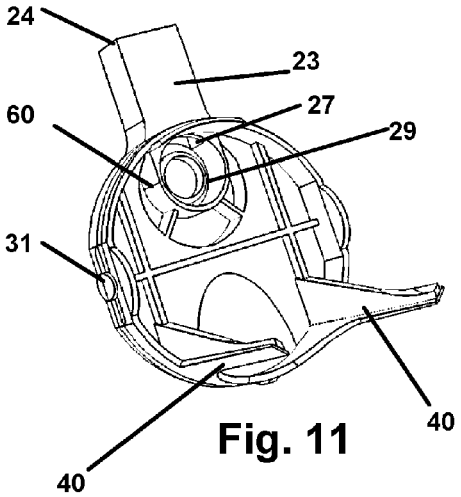
FIG. 11 shows the dispensing component of FIG. 10 and depicts an angled seal surrounding a conduit leading to an exit aperture for fluid from the dispensing component.

In FIG. 11, mating side of the nozzle 22 is shown. As can be seen, an annular seal 29 is formed within a ring 60 sized to surround the annular projection 45 defining the conduit 46 shown in FIG. 8. As can be discerned, with the nozzle 22 in the first position (non depressed) the annular seal 29 engages with the distal edge of the annular projection 45 and prevents fluid communication through the conduit 46 from the bottle 16, to the nozzle aperture 27 in communication with a fluid path leading to the dispensing aperture 24.

However, when the nozzle 22 is rotated to the depressed position noted above, the seal 60 disengages from the distal edge of the annular projection of FIG. 11, and a fluid pathway from the interior of the bottle 16, through the conduit 46 to the nozzle aperture 27 and exiting from the dispensing aperture 24 is formed. Thus, in the firs position of the nozzle 22, the fluid pathway is blocked, and in the depressed position of the nozzle 22 depicted earlier, fluid flow from the interior of the bottle 16 to the dispensing aperture 24 is allowed along the noted fluid pathway.

Figure 12:
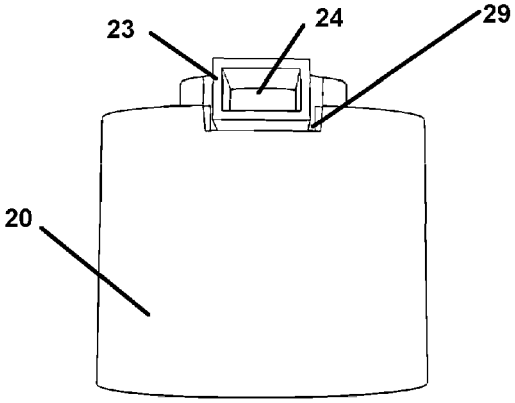
FIG. 12 depicts a frontal view of the cap showing the exit aperture of the dispensing component at the distal end of a nozzle, in recessed engagement with a slot formed in the collar component of the cap.
Figure 9:
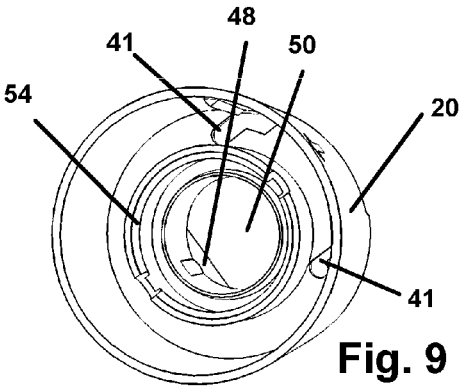
FIG. 9 depicts the collar of FIG. 8 from an opposite angle view showing a cavity having an angled wall and an opening communicating with a fluid path to the conduit of FIG. 8.

FIG. 12 shows a frontal view of the collar 20 and shows the nozzle 22 in the first position, and also shows the projecting portion 23 in a recessed engagement within a slot 29 formed into an upper edge of the collar 20 component of the nozzle assembly 18. Once moved to the depressed position such as in FIG. 1 or 6, the projecting portion 23 will angle upward from the slot 29.

Figure 13:
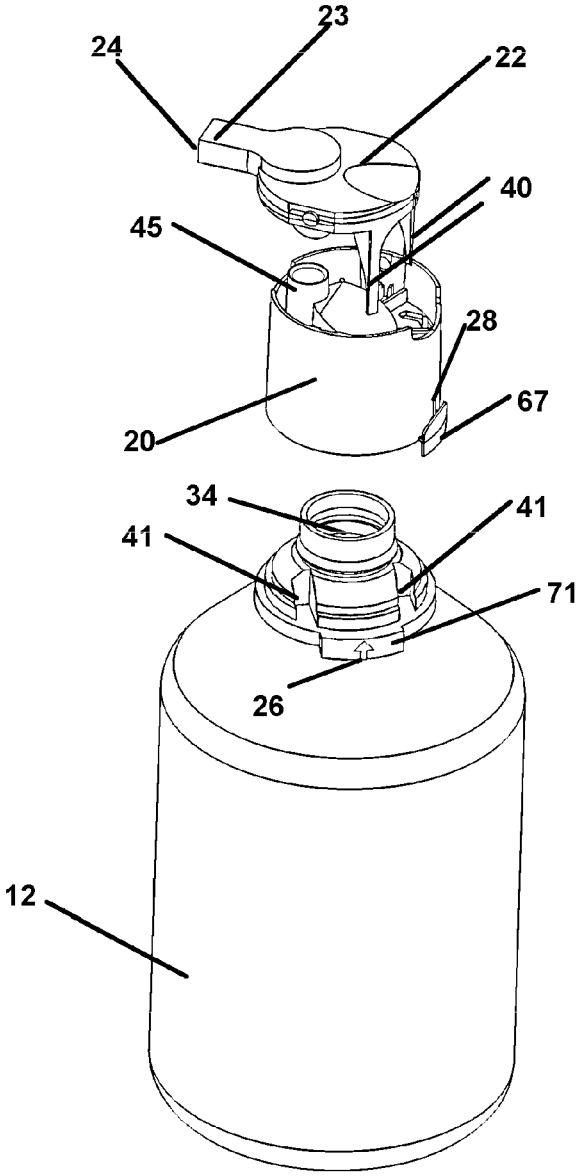
FIG. 13 depicts an exploded view of the bottle device components an showing the removably engaged visually discernable tamper component.
Figure 14:
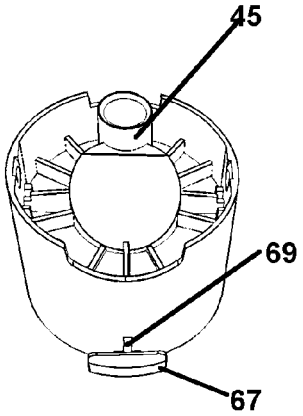
FIG. 14 shows another view of the collar of FIG. 10 and the spaced positioning of the removable tamper member which prevents rotation of the collar until removed.

In FIG. 13, is depicted an exploded view of the bottle 12 of the device 10 with the nozzle 22 in the first position wherein movement to the depressed position is prevented because the projecting members 40 do not align with the recesses 42 formed into the surface of the bottle 12. Also shown both in FIG. 14 and FIG. 14, is a particularly preferred removable tab 67 that provides a visually discernable alarm to a purchaser of the device 10 to determine if a tampering with the device 10 and potentially the contents of the bottle 12, has occurred. The tab 67 is engaged with the collar 20 with a pillar 69 communicating between a connection to the collar 20 and to an interior surface of the tab 67. The tab 67 and pillar 69 are removable from engagement to the collar 20 by pulling on the tab 67 which will tear the pillar 69 from the collar 20.

However, until such removal of the tab 67 and pillar 69, the second marker 28 is substantially covered from viewing by the user and alignment with the first marker 26. Further, until removed, the tab 67 also will prevent rotation of the collar 20 to align the first marker 26 with the second marker 28 because the tab 67 will contact a shoulder 71 formed on the exterior surface of the bottle 12 adjacent the dispensing end.

While all of the fundamental characteristics and features of the disclosed squeeze bottle have been shown and described, a latitude of modification, various changes and substitutions are intended in the foregoing disclosure. It will be apparent that in some instance, some features of the invention may be employed without a corresponding use of other features, or steps may be rearranged for operations, without departing from the scope of the invention as set forth. It should be understood that any such substitutions, modifications, and variations, which might be made by those skilled in the art, without departing from the spirit or scope of the invention as disclosed herein are considered included within the scope of the invention as defined herein.

What is claimed is:

1. A liquid dispensing container, comprising:

a container having a sidewall surrounding an interior cavity;

an aperture at a first end of said container communicating with said interior cavity;

a cap assembly having an circular collar having a nozzle pivotally engaged at a first end of said collar;

a central portion of said nozzle positioned within a circumference of said collar and an projecting portion extending from said central portion a distance outside said circumference of said collar;

a fluid pathway running through said nozzle from a communication with said aperture, to a dispensing aperture at a distal end of said projecting portion;

said collar rotationally engaged at said first end of said container;

said collar positionable from a safety position to a dispensing position by rotation thereof to an alignment of a first marker on said collar with a second marker fixed in position upon said container;

said nozzle fixed in a first position with said collar in said safety position;

said fluid pathway running through said nozzle being blocked with said nozzle in said first position;

said nozzle pivotable from said first position, to a second position, with said collar in said dispensing position;

said nozzle being fixed in said first position by at least one projecting member engaged at a first end with said central portion of said nozzle, and extending to a distal end in a slidable contact with a race formed into said container;

a recess formed in said container intersecting said race;

said projecting member in an alignment with said recess only with said collar in said dispensing position;

pivoting said nozzle to said second position, with said collar in said dispensing position, translating said distal end of said projecting member into said recess and opening said fluid pathway running through said nozzle, whereby said fluid is prevented from exiting said dispensing aperture until both said collar is rotated to reach said alignment of said first marker and said second marker, and, said nozzle is then pivoted to said second position.

2. The liquid dispensing container of claim 1 additionally comprising:

a slot formed in a first end of said collar, said slot sized for communication of a central section of said projecting portion of said nozzle therethrough from a substantially horizontal disposition with said nozzle pivoted to said first position, to an inclined disposition with said nozzle pivoted to said second position.

3. A liquid dispensing container, comprising:

a container having a sidewall surrounding an interior cavity;

an aperture at a first end of said container communicating with said interior cavity;

a cap assembly having an circular collar having a nozzle pivotally engaged at a first end of said collar;

a central portion of said nozzle positioned within a circumference of said collar and an projecting portion extending from said central portion a distance outside said circumference of said collar;

a fluid pathway running through said nozzle from a communication with said aperture, to a dispensing aperture at a distal end of said projecting portion;

said collar rotationally engaged at said first end of said container;

said collar positionable from a safety position to a dispensing position by rotation thereof to an alignment of a first marker on said collar with a second marker fixed in position upon said container;

said nozzle fixed in a first position with said collar in said safety position;

said fluid pathway running through said nozzle being blocked with said nozzle in said first position;

said nozzle pivotable from said first position, to a second position, with said collar in said dispensing position;

pivoting said nozzle to said second position opening said fluid pathway running through said nozzle;

said nozzle fixed in said first position by at least one projecting member engaged at a first end with said central portion of said nozzle, and extending to a distal end in a slidable contact with a race formed into said container in a position adjacent a second end of said collar, opposite said first end of said collar;

a slot formed in a first end of said collar, said slot sized for communication of a central section of said projecting portion of said nozzle therethrough from a substantially horizontal disposition with said nozzle pivoted to said first position, to an inclined disposition with said nozzle pivoted to said second position; and whereby said fluid is prevented from exiting said dispensing aperture until both said collar is rotated to reach said alignment of said first marker and said second marker, and, said nozzle is then pivoted to said second position.

4. The liquid dispensing container of claim 1 additionally comprising:

a slot formed in a first end of said collar, said slot sized for communication of a central section of said projecting portion of said nozzle therethrough from a substantially horizontal disposition with said nozzle pivoted to said first position, to an inclined disposition with said nozzle pivoted to said second position.

5. A liquid dispensing container, comprising:

a container having a sidewall surrounding an interior cavity;

an aperture at a first end of said container communicating with said interior cavity;

a cap assembly having an circular collar having a nozzle pivotally engaged at a first end of said collar;

a central portion of said nozzle positioned within a circumference of said collar and an projecting portion extending from said central portion a distance outside said circumference of said collar;

a fluid pathway running through said nozzle from a communication with said aperture, to a dispensing aperture at a distal end of said projecting portion;

said collar rotationally engaged at said first end of said container;

said collar positionable from a safety position to a dispensing position by rotation thereof to an alignment of a first marker on said collar with a second marker fixed in position upon said container;

said nozzle fixed in a first position with said collar in said safety position;

said fluid pathway running through said nozzle being blocked with said nozzle in said first position;

said nozzle pivotable from said first position, to a second position, with said collar in said dispensing position;

said nozzle is fixed in said first position by a pair of projecting members each engaged at a first end with said central portion of said nozzle and each extending to a respective distal end in a slidable contact with a race formed into said container in a position adjacent a second end of said collar opposite said first end of said collar; and pivoting said nozzle to said second position opening said fluid pathway running through said nozzle, whereby said fluid is prevented from exiting said dispensing aperture until both said collar is rotated to reach said alignment of said first marker and said second marker, and, said nozzle is then pivoted to said second position.

6. he liquid dispensing container of claim 5 additionally comprising:

a pair of recesses formed in said container, each intersecting said race;

each said projecting member in a respective alignment with one respective said recess by a positioning of said collar to said dispensing position; and pivoting said nozzle to said second position, with said collar in said dispensing position, translating each of said distal ends of each said projecting member into a respective said recess.

7. The liquid dispensing container of claim 6 additionally comprising:

a slot formed in a first end of said collar, said slot sized for communication of a central section of said projecting portion of said nozzle therethrough and movement therein from a substantially horizontal disposition with said nozzle pivoted to said first position, to an inclined disposition therethrough with said nozzle pivoted to said second position.

8. The liquid dispensing container of claim 1 additionally comprising:

a removable pillar having an engaged position to an exterior surface of said collar adjacent said second end thereof;

said pillar impairing a viewing of said first marker by a user;

a shoulder portion formed onto an exterior surface of said container proximate to said second end of said collar;

said pillar preventing rotation of said collar from said safety position to said dispensing position; and said pillar when removed from said engaged position providing a visually discernable alarm to a user that tampering has occurred with said liquid dispensing container.

9. The liquid dispensing container of claim 6 additionally comprising:

a removable pillar having an engaged position to an exterior surface of said collar adjacent said second end thereof;

said pillar impairing a viewing of said first marker by a user;

a shoulder portion formed onto an exterior surface of said container proximate to said second end of said collar;

said pillar preventing rotation of said collar from said safety position to said dispensing position; and said pillar when removed from said engaged position providing a visually discernable alarm to a user that tampering has occurred with said liquid dispensing container.

* * * * *